US012710184B2

(12) United States Patent
Janesky

(10) Patent No.: US 12,710,184 B2
(45) Date of Patent: Aug. 18, 2026

(54) ENERGY MANAGEMENT SYSTEMS

(71) Applicant: Tanner Janesky, Hurricane, UT (US)

(72) Inventor: Tanner Janesky, Hurricane, UT (US)

( * ) Notice: Subject to any disclaimer, the term of this patent is extended or adjusted under 35 U.S.C. 154(b) by 118 days.

(21) Appl. No.: 18/769,908

(22) Filed: Jul. 11, 2024

(65) Prior Publication Data

US 2025/0020345 A1 Jan. 16, 2025

Related U.S. Application Data

(60) Provisional application No. 63/526,064, filed on Jul. 11, 2023.

(51) Int. Cl.

| | |
|---|---|
| ***F24F 5/00*** | (2006.01) |
| ***F24F 11/46*** | (2018.01) |
| ***F24F 110/10*** | (2018.01) |
| ***F24F 110/12*** | (2018.01) |
| ***F24H 4/04*** | (2006.01) |

(52) U.S. Cl.

CPC ..... *F24F 5/0017* (2013.01); *F24F 11/46* (2018.01); *F24H 4/04* (2013.01); *F24F 5/0021* (2013.01); *F24F 2005/0025* (2013.01); *F24F 2005/0067* (2013.01); *F24F 2110/10* (2018.01); *F24F 2110/12* (2018.01); *F24F 2203/021* (2013.01)

(58) Field of Classification Search

CPC ..... F24F 5/0017; F24F 11/46; F24F 2110/10; F24F 2110/12; F24F 5/0021; F24F 2005/0025; F24F 2005/0067; F24F 2203/021; F24F 11/30; F24H 4/04

USPC ..... 165/236

See application file for complete search history.

(56) References Cited

U.S. PATENT DOCUMENTS

| | | | | |
|---|---|---|---|---|
| 6,712,069 | B1 * | 3/2004 | Spangler | F24S 80/54 126/634 |
| 6,959,520 | B2 | 11/2005 | Hartman | |
| 7,441,558 | B2 | 10/2008 | Leifer et al. | |
| 7,958,885 | B2 | 6/2011 | Leifer et al. | |
| 8,667,806 | B2 * | 3/2014 | Sinha | H10F 77/68 62/235.1 |
| 8,833,076 | B2 * | 9/2014 | Sonwane | F28D 20/0034 60/659 |
| 9,153,847 | B2 | 10/2015 | Harty | |
| 9,677,809 | B1 | 6/2017 | Eustis | |
| 9,868,357 | B2 | 1/2018 | McCalmont et al. | |
| 10,060,296 | B2 | 8/2018 | Friesth | |
| 10,746,480 | B2 | 8/2020 | Eustis | |
| 11,318,850 | B2 | 5/2022 | McCalmont et al. | |
| 2009/0173336 | A1 | 7/2009 | Leifer et al. | |
| 2013/0068418 | A1 | 3/2013 | Gotland et al. | |

(Continued)

FOREIGN PATENT DOCUMENTS

| | | | | |
|---|---|---|---|---|
| CN | 101458005 A * | 6/2009 | | F25B 27/005 |
| CN | 111628500 A * | 9/2020 | | H02J 13/10 |

(Continued)

*Primary Examiner* — Jon T. Schermerhorn, Jr.

(74) *Attorney, Agent, or Firm* — Barclay Damon LLP; Anthony P. Gangemi

(57) ABSTRACT

Systems are provided for capturing and utilizing excess electrical current. In some embodiments, a thermal management system converts excess current (from, for example, a solar power installation) to thermal energy that is then employed by the facility or stored for later use using one or more of a heat storage tank and a cold storage tank.

11 Claims, 8 Drawing Sheets

(56) References Cited

U.S. PATENT DOCUMENTS

| | | | |
|---|---|---|---|
| 2015/0276253 | A1 | 10/2015 | Montalvo |
| 2018/0347406 | A1 | 12/2018 | Friesth |
| 2022/0250486 | A1 | 8/2022 | McCalmont et al. |

FOREIGN PATENT DOCUMENTS

| | | | | | |
|---|---|---|---|---|---|
| CN | 118816412 | A | * 10/2024 | ..... | F28D 20/021 |
| WO | WO-2010081421 | A1 | * 7/2010 | ..... | F25B 27/005 |

* cited by examiner

230

ENERGY MANAGEMENT SYSTEMS

CROSS REFERENCE TO RELATED APPLICATION(S)

This application claims the benefit of U.S. Provisional Application No. 63/526,064, filed Jul. 11, 2023, which is incorporated by reference as if disclosed herein in its entirety.

FIELD

The present disclosure relates to energy management systems, and particularly to energy management systems for homes, commercial establishments, and other facilities that can utilize available excess electrical energy to power thermal management systems, including the storage of thermal energy for later use by the facility.

BACKGROUND

Solar photovoltaic (PV) panels effectively generate electrical energy for residential use when solar energy is available. However, they are unable to produce electrical energy during the night. They also have intermittent outputs based on weather conditions, such as temperature and cloud coverage. Single-facility-based solar power systems often produce more electrical energy than is required by the facility during the middle of the day, resulting in excess electrical energy that is exported to the power grid. There is a temporal mismatch between solar energy supply and home and building energy demand.

Some solutions incorporate an electrochemical battery into the facility solar power system for storing the excess electrical energy. However, facility-based solar power systems often produce more electrical energy than can be used to charge the electrochemical battery, because of limitations on battery charge rates or capacity, still resulting in excess electrical energy exported to the power grid. Additionally, electrochemical batteries degrade over time and are expensive to maintain and replace and contain rare metals that cause environmental disruption to extract.

What is needed, therefore, is an improved energy management system that at least partially addresses the problems described above.

SUMMARY

To at least partially address the problems described above, some embodiments of the present technology are directed to systems for homes, buildings, and any other facility to use and store energy on site to minimize the need for imported grid power or chemical batteries. In some embodiments, energy is provided to the facility from photovoltaic panels. In some embodiments, the difference between solar electrical power production and electricity usage on site is measured, and excess electrical power is regulated and used to power a heating, ventilation, and cooling (HVAC) system and a thermal energy storage system to heat and cool the facility even when solar electricity is not being produced. In some embodiments, a refrigeration system is capable of both heating and cooling heat transfer fluids simultaneously. In some embodiments, the heated heat transfer fluid loop is capable of providing space or ambient heating, domestic hot water, and thermal energy storage in a "hot" thermal energy storage reservoir or heat storage tank. In some embodiments, the cooled heat transfer fluid loop is capable of providing space cooling and "cold" thermal energy storage in the form of chilled water and its phase change to ice. In some embodiments, both the "hot" and "cold" thermal energy storage reservoirs are capable of delivering their stored heating or cooling load to the home or building without the need to run the refrigeration system's compressor, thereby reducing the need to import grid power or use electrical energy stored in batteries when photovoltaic panels are not producing electrical energy.

BRIEF DESCRIPTION OF DRAWINGS

The drawings show embodiments of the disclosed subject matter for the purpose of illustrating features and advantages of the disclosed subject matter. However, it should be understood that the present application is not limited to the precise arrangements and instrumentalities shown in the drawings, wherein.

Although the following Detailed Description will proceed with reference being made to illustrative embodiments, many alternatives, modifications, and variations thereof will be apparent to those skilled in the art.

DETAILED DESCRIPTION

Figure 1:
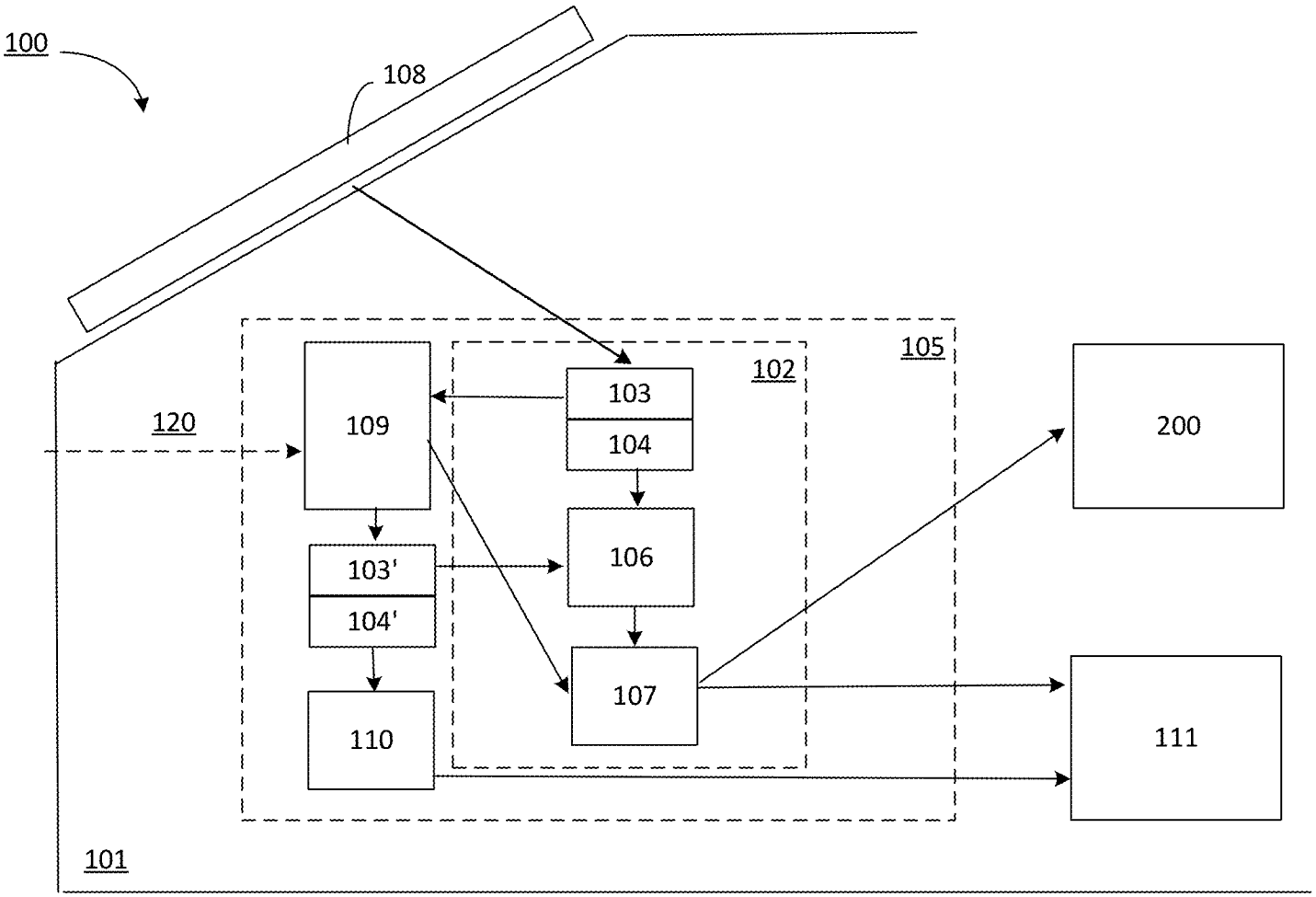
FIG. 1 is a schematic functional block diagram of a system according to an embodiment of the present technology.

Accordingly, a first embodiment of the present technology is shown in FIG. 1, which depicts a functional block diagram of a system 100 for managing energy in a facility 101. In some embodiments, the system 100 includes an electrical energy measurement circuitry 102 which, in some embodiments, is part of an electrical power system 105 of the facility 101. In some embodiments, the electrical energy measurement circuitry 102 comprises one or more ammeters 103 and one or more voltmeters 104 that are configured to measure an amount of electrical power supplied to the facility 101 and an amount of electrical power demanded by the facility 101. In some embodiments, the ammeter comprises a current transformer (CT) for measuring the AC current flowing into the electrical power system 105. In other embodiments, other types of ammeters or current measurement devices are used. In some embodiments that utilize a solar PV power source, this measuring device is located after the main inverter(s) and combiner box. In some embodiments, additional ammeters are used to measure the current in the hot wires feeding into the facility's main circuit breaker panel in order to measure the facility's total power consumption or demand. In some embodiments, one or more voltmeters are also used to measure the voltage applied by an electrical source (e.g., from the solar photovoltaic system) and the voltage applied as inputs to the main circuit breaker.

In some embodiments, the system further comprises a solar photovoltaic system 108 in electrical communication with the electrical power system 105, where the solar photovoltaic system is configured to convert solar energy into electrical energy and send the electrical energy to the electrical power system. In some embodiments, the electrical power system 105 is also configured to receive electric service 120 from a power utility.

In some embodiments, the electrical energy measurement circuitry 102 further comprises: a first ammeter 103 in electrical communication with the solar photovoltaic system 108, the first ammeter 103 configured to measure the current sent from the solar photovoltaic system 108; a first voltmeter 104 in electrical communication with the solar photovoltaic system 108, the first voltmeter 104 is configured to measure the voltage sent from the solar photovoltaic system 108. In some embodiments, the system 100 further comprises at least one second ammeter 103' in electrical communication with a circuit 109 of the electrical power system 105, the at least one second ammeter 103' configured to measure the total current drawn from the circuit 109; and at least one second voltmeter 104' in electrical communication with the circuit 109 of the electrical power system 105, the at least one second voltmeter 104' configured to measure the total voltage drawn from the circuit 109. In some embodiments, the circuit 109 is the main circuit breaker for the facility's electrical system. The at least one ammeter 103' and at least one voltmeter 104' measure the electricity supplied to the facility's electrical devices and appliances 110. In some embodiments, the electrical energy measurement circuitry 102 also comprises a controller circuitry 106 configured to calculate an amount of available excess electrical power from the measured amounts of current and voltage. The controller circuitry 102, in some embodiments, therefore, is configured to receive the measurements from the first and second ammeters 103, 103' and voltmeters 104, 104' to calculate the amount of available excess electrical current.

Multiplying the current by the voltage yields the power. This measurement data is sent to a controller that contains logic for calculating how much excess power (and current), if any, is available by performing the following equation:

$$[(\text{Voltage}_{supplied}\times\text{Current}_{supplied})-(\text{Voltage}_{demand}\times\text{Current}_{demand})]+\text{Voltage}_{demand}=\text{Current}_{available}$$

In some embodiments, the electrical energy measurement circuitry 102 also comprises a current regulator 107 configured to regulate the available excess current within the electrical power system 105 of the facility. Thus, in some embodiments, once the excess available current based on excess electrical power supply (such as excess solar production) is determined, the current regulator 107 is used to regulate the excess current flowing within the facility power system. In some embodiments, the current regulator 107 includes power semiconductors, such as metal-oxide-semiconductor field-effect transistors (MOSFET), insulated-gate bipolar transistors (IGBT), or similar devices.

Figure 2A:
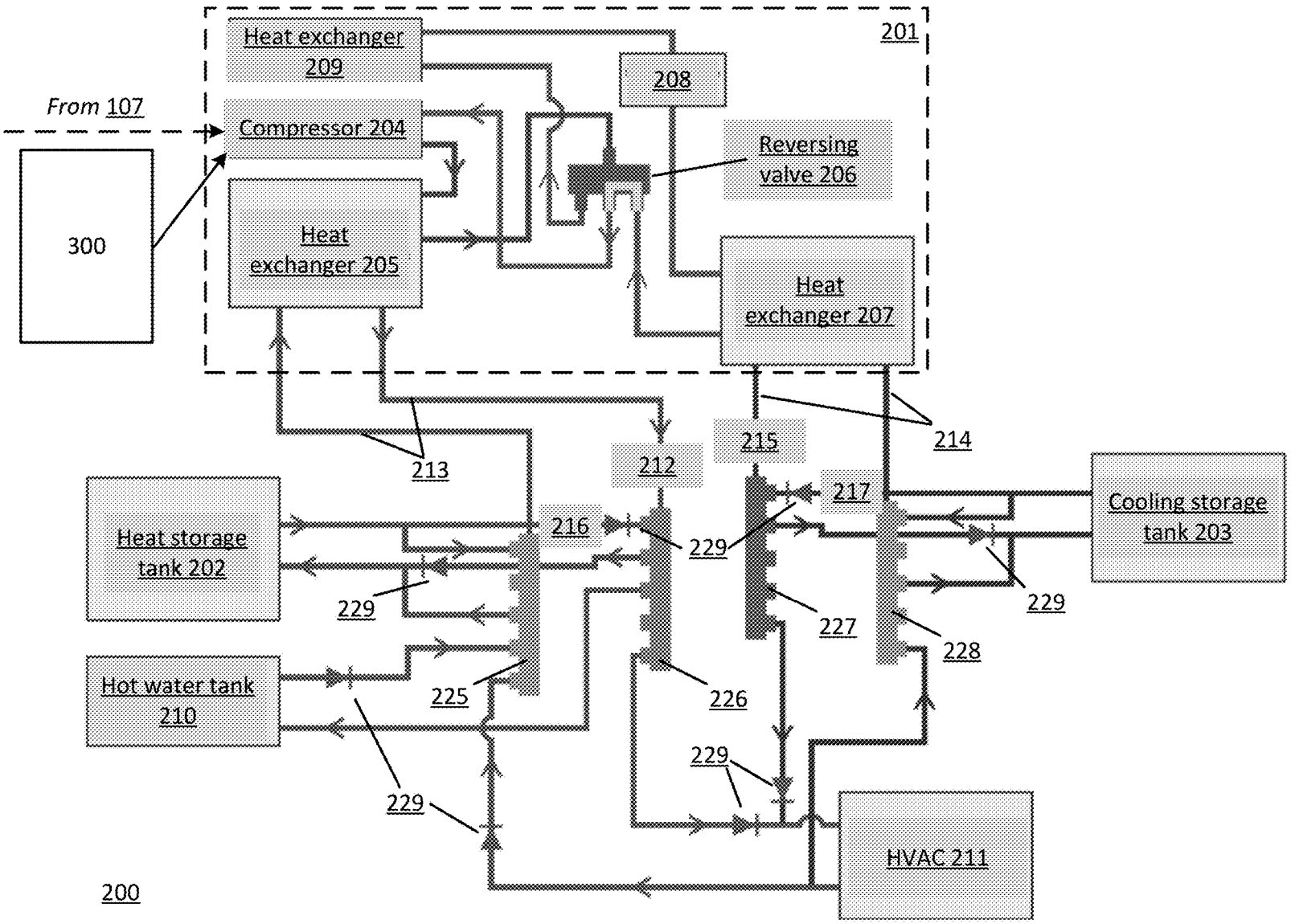
FIG. 2A is a schematic functional block diagram of a thermal management system according to an embodiment of the present technology.

The system 100 further comprises a thermal energy management system 200, an embodiment of which is shown in detail in FIG. 2A. In some embodiments, the thermal energy management system 200 comprises a heat pump 201 in electrical communication with the current regulator 107 and configured such that its operation is regulated by the current regulator 107. The system 200 further comprises a heat storage tank 202, thermally coupled to the heat pump 201, and a cold storage tank 203, thermally coupled to the heat pump 201.

In some embodiments, the heat storage tank comprises one or more of: water and a phase change material. In some embodiments, water is used. In some embodiments, paraffin wax is used. In some embodiments, the heat storage tank comprises a heat exchanger as well as the water or other phase change material.

In some embodiments, the cold storage tank comprises water. In some embodiments, the cold storage tank comprises a heat exchanger as well as the water or other phase change material.

In some embodiments, as shown in FIG. 2A, the heat pump comprises a compressor 204, a first heat exchanger 205 that couples the heat pump to the heat storage tank 202; a reversing valve 206; a second heat exchanger 207 that couples the heat pump to the cold storage tank 203; one or more metering devices 208, and a third heat exchanger 209 that couples the heat pump to the environment external to the facility (e.g., the outside air).

In some embodiments, refrigerant in the heat pump 201 heats a glycol solution 213 via the first heat exchanger 205 to provide heat to one or more of the heat storage tank 202, a hot water tank 210, and a facility heating, cooling, and ventilation (HVAC) system 211 via a first glycol pump 212. In other embodiments, a heat transfer solution other than a glycol solution is used. In some embodiments, refrigerant in the heat pump 201 cools a second glycol solution 214 via the second heat exchanger 207 to provide cooling to the cold storage tank 203 and the facility HVAC system 211 via a second glycol pump 215. As described herein, the heat pump receives current from the current regulator 107. In some embodiments, separate facility ambient temperature management equipment is used for the heating mode and cooling mode of the system, respectively. For example, for the heating mode, an air handler unit or fan coil unit or radiant floor heating or baseboard radiators are used in some embodiments for heating, while an air handler unit or fan coil unit is used for cooling in some embodiments. In some embodiments, separate equipment is used, and in some embodiments a single set of equipment such as an HVAC system is used.

In some embodiments, the thermal management system 200 further comprises a third glycol pump 216 associated with the heat storage tank 202. In some embodiments, the thermal management system 200 further comprises a fourth glycol pump 217 associated with the cold storage tank 203.

In some embodiments, the heat pump and the other components of the thermal management system have two primary modes of operation: a first mode when the temperature external to the facility is above the ambient temperature range set by a user of the system (a "summer" or "warm weather" mode) and a second mode when the temperature external to the facility is below the ambient temperature range set by a user of the system (a "winter" or "cold weather" mode). FIG. 2A shows the heat pump operating in "summer" mode. In this embodiment, the heat pump 210 comprises a vapor compression heat pump. In the mode depicted in FIG. 2A, the compressor 204 pumps high pressure, high temperature refrigerant through the heat exchanger 205. When the first glycol pump 212 is not operating, the heat exchanger 205 will not extract significant heat from the refrigerant. When the first glycol pump 212 is operating, the glycol solution 213 will extract heat for depositing in the heat storage tank 202, the hot water tank 210, and/or the HVAC 211. The system 200 includes check valves 229, which allow flow only in the direction indicated by the arrow and ensure flow along the intended paths.

After flowing through the heat exchanger 205, the refrigerant flows through the reversing valve 206 and then to the heat exchanger 209, then the metering device(s) 208. In some embodiments, the metering device comprises one or more thermal expansion valves (TXV), electronic expansion valves (EXV), or similar devices. Then, the now low-temperature, low-pressure refrigerant runs through the heat exchanger 207 to extract heat from (i.e., deposit cold in) the glycol solution 214 by evaporating the refrigerant. When the second glycol pump 215 is running, the low-temperature refrigerant in the heat pump 210 will extract significant heat from the glycol 214, which will, in turn, extract heat from the cold storage tank 203 and/or enable cooling via the HVAC 211.

The refrigerant then flows back through the reversing valve and back to the compressor 204.

Figure 2B:
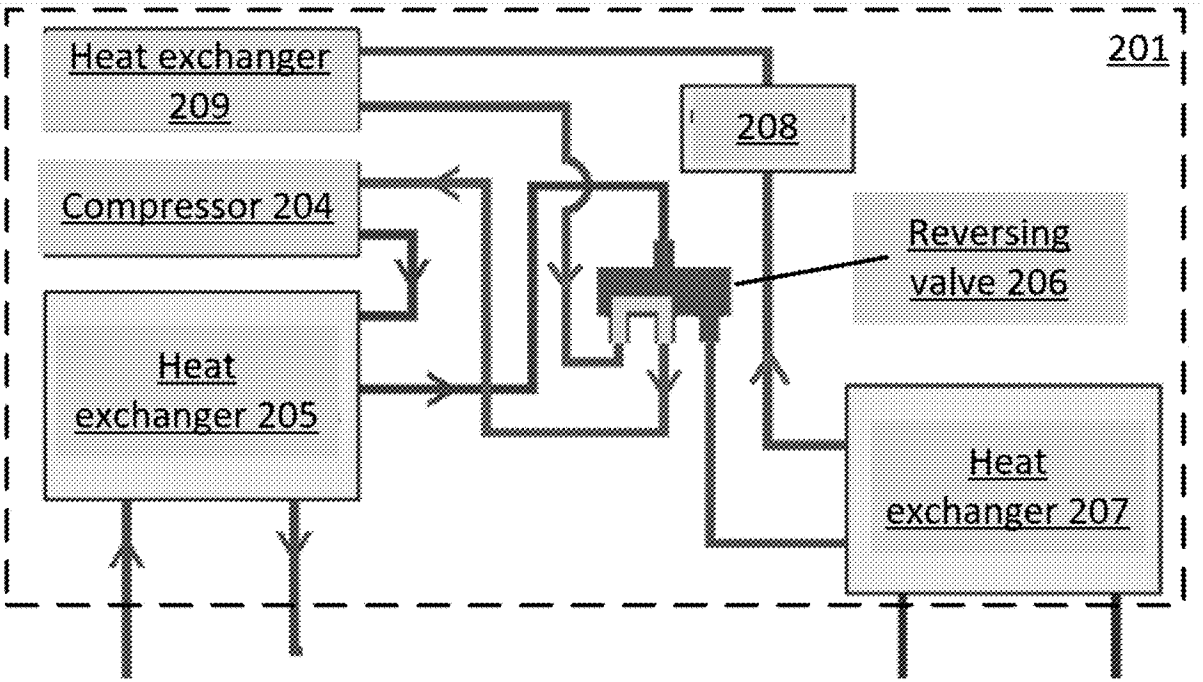
FIG. 2B is a schematic functional block diagram of the heat pump of FIG. 2A in a cold-weather operation mode.

FIG. 2B shows the heat pump 201 operating in winter mode. In this mode, the reversing valve has been switched as shown. High-temperature, high-pressure refrigerant flows from the compressor 204 to the heat exchanger 205, where significant heat is transferred to the glycol solution 213 for depositing in the heat storage tank 202, the hot water tank 210, and/or the HVAC 211. The refrigerant then travels through the reversing valve 206 and through the heat exchanger 207. In "winter" mode, the glycol 214 will not extract significant heat from the refrigerant unless the second glycol pump 215 is running. The refrigerant then runs through the metering devices 208 where it is converted to a low-temperature, low-pressure liquid, outdoor heat exchanger 209 now acting as an evaporator that picks up heat from the outdoor air and evaporates the refrigerant, back through the reversing valve 206, and to the compressor 204.

Figure 2C:
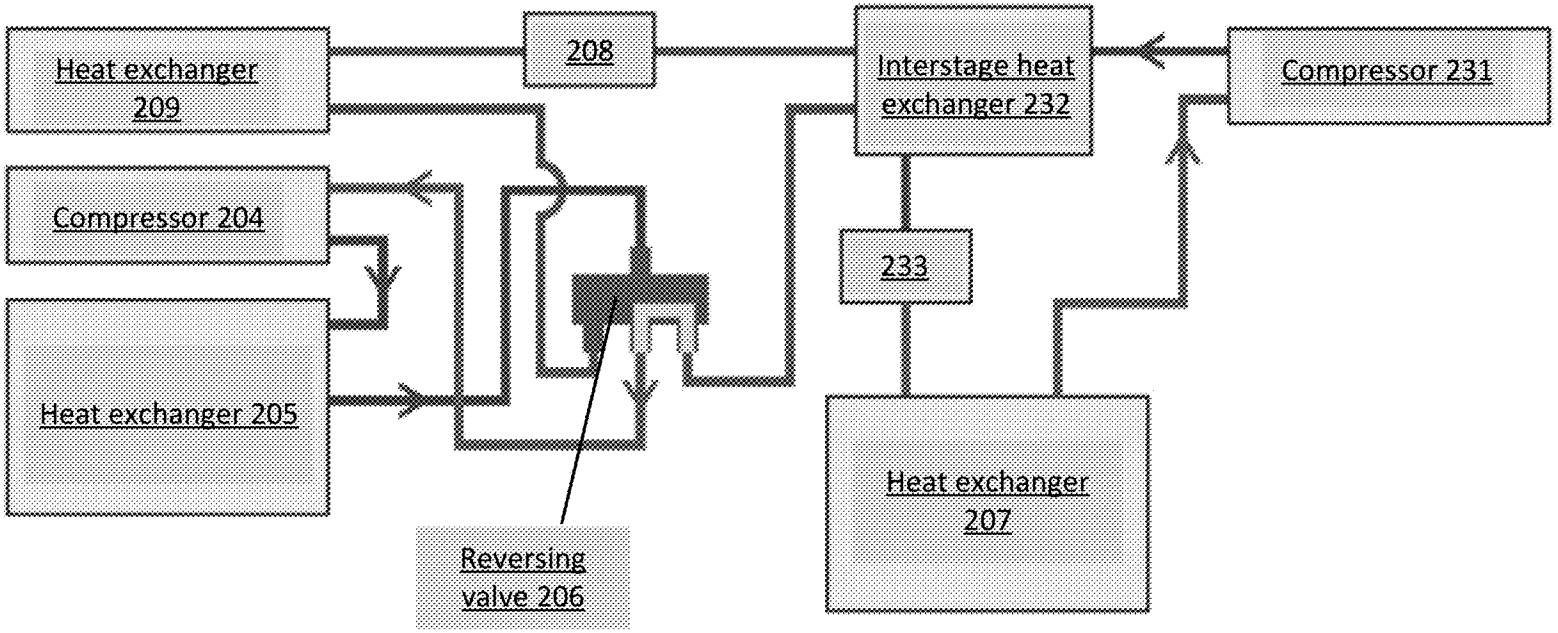
FIG. 2C is a schematic functional block diagram of an alternative heat pump according to an alternative embodiment of the present technology.

FIG. 2C is a schematic functional block diagram of an alternative heat pump according to an alternative embodiment of the present technology. More specifically, FIG. 2C shows a cascade two-stage refrigeration system (i.e., heat pump) 230 with a secondary refrigeration cycle for cooling the glycol to lower temperatures, especially useful in warm-weather mode. In heat pump 230, a second refrigerant loop includes a second compressor 231, an interstage heat exchanger 232, a second set of one or more metering devices 233, and the heat exchanger 207 (which interfaces with the cold glycol loop in FIG. 2A). The compressor 231 provides high-temperature, high-pressure refrigerant to an interstage heat exchanger 232, which enables the low-temperature low-pressure refrigerant coming from the metering device(s) 208 to evaporate and extract heat from the refrigerant in the secondary cycle. After the secondary refrigerant moves through the metering devices 233, it is at a lower temperature and pressure than possible with the single stage refrigeration system of FIGS. 2A and 2B. This extra low temperature and pressure refrigerant is passed through the heat exchanger 207 to cool the glycol solution 214 below the level possible with a single stage heat pump as in FIG. 2A, and with a higher COP (coefficient of power).

Figure 2D:
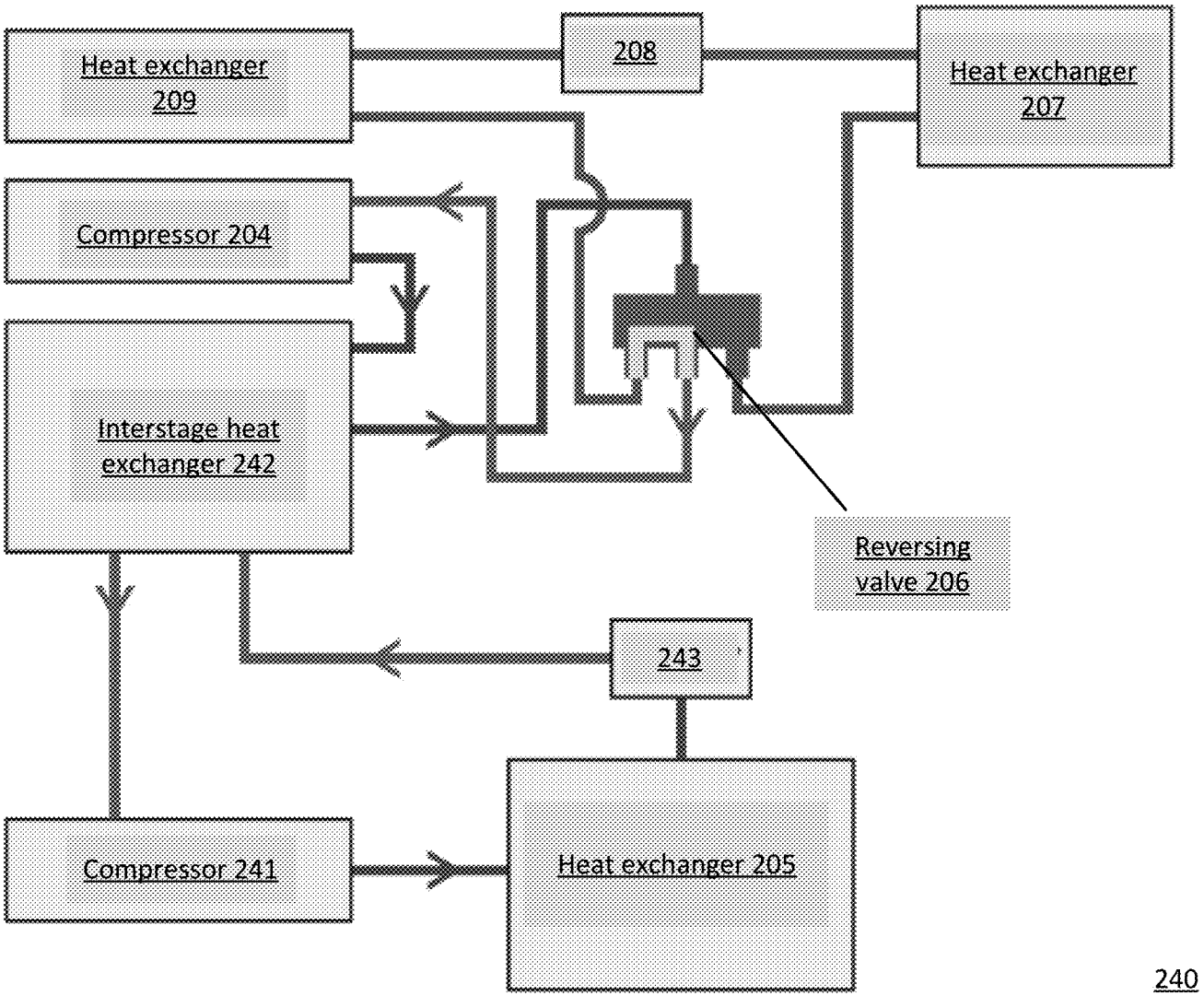
FIG. 2D is a schematic functional block diagram of an additional alternative heat pump according to an additional alternative embodiment of the present technology.

FIG. 2D is a schematic functional block diagram of an additional alternative heat pump according to an additional alternative embodiment of the present technology. More specifically, FIG. 2D shows a cascade two-stage refrigeration system (heat pump 240) with a secondary refrigeration cycle for heating the glycol to higher temperatures especially useful in cold-weather mode. The heat pump 240 also includes a second compressor 241, an interstage heat exchanger 242, and a second set of one or more metering devices 243. In heat pump 240, the additional components extract heat from the high-temperature, high pressure refrigerant from the compressor 204 via the interstage heat exchanger 242 and then compressor 241 raises the temperature of the refrigerant even further before it enters the heat exchanger 205, which interfaces with the hot glycol loop.

Thus, in some embodiments, the system comprises a cascade two stage vapor compression refrigeration cycle, with the addition of a secondary compressor and/or metering device. This is designed to improve the coefficient of performance (COP) of the refrigeration system when operating over large temperature and pressure differentials. In some embodiments, therefore, a second heat pump is arranged in a cascading two-stage relationship with the first heat exchanger 205. In some embodiments, a third heat pump is arranged in a cascading two-stage relationship with the second heat exchanger 207. In other embodiments, one or more additional compressors are used in the heat pump to provide two-stage compression and, thereby, higher COP.

Thus, in some embodiments, the heat pump is configured for heating or cooling a glycol solution within a pipe network of the thermal energy management system 200. When heating the facility is desired, the heated glycol 213 is pumped through a glycol-to-air heat exchanger in an air handler unit or fan coil unit, or other type of heat exchanger inside of the facility, such as radiant floor heating or baseboard radiators, (e.g., HVAC 211). When the desired temperature is reached and solar energy is still available, the heat pump 201 continues to run in heating mode to heat the glycol. The hot glycol is pumped through an indirect style hot water heater 210, in some embodiments, which can also have a resistive heating element or an additional heat pump in some embodiments, and/or a heat storage tank 202 that includes a heat exchanger and water or paraffin wax or similar phase change material (PCM). In some embodiments, the heat from the glycol either heats water or melts the paraffin wax, storing that thermal energy in its phase change and/or increased temperature. In some embodiments, valves 225, 226 control where the hot glycol is sent based on if domestic hot water or heat storage is needed. This process continues as long as excess solar energy is available until the full volume of the domestic hot water tank and the thermal storage tank have reached their set temperatures and "states of charge."

In some embodiments, when heating the facility is desired and excess solar power is not available to do so, hot glycol is pumped from the heat storage tank 202 to the heat exchanger in the air handler unit, fan coil units, radiators, or HVAC 211 to heat the facility. This process uses very little power compared to heating the facility with the heat pump.

In some embodiments, when cooling the facility is desired, glycol is cooled by the heat pump 201, and the cold glycol is pumped through the glycol-to-air heat exchanger in an air handler unit or fan coil unit 211 or other type of heat exchanger inside of the facility. When the desired temperature is reached and solar energy is still available, the heat pump continues to run in cooling mode to cool the glycol to below the freezing temperature of water. The cold glycol is pumped through a cold storage tank 203 that includes a heat exchanger and water in some embodiments. The heat from the water is transferred into the cold glycol until the water freezes and builds ice. This stores cooling capacity for the facility in the phase change of water. Valves 227 and 228 control where the cold glycol is sent. In some embodiments, valves 225, 226, 227, and 228 are electronically controlled multiport valves.

In some embodiments, when cooling the facility is desired and excess solar power is not available to do so, cold glycol is pumped from the cold storage tank 203 to the heat exchanger in the air handler unit or fan coil units 211 to cool the facility until the ice is fully melted and the temperature rises above a temperature threshold where it is no longer cold enough to cool the facility. This process uses very little power compared to cooling the facility with the heat pump.

In some embodiments, the "waste" heat from the cooling of the facility or the freezing of the water in the cold storage tank 203 is transferred into the domestic hot water tank via a heat exchanger and a separate glycol loop. Thus, some embodiments of the facility energy management system store excess solar energy as thermal energy for both heating and cooling of a facility as well as domestic hot water, reducing the need for expensive chemical battery storage. In some embodiments, if the facility is desired to be made grid-independent, a much smaller battery (as compared to the electrochemical batteries discussed above) is included to provide backup power to the system.

In some embodiments, a software system comprising software logic is used to determine when the heat pump 201 and other components of the thermal energy management system should run. In some embodiments, a mobile and/or desktop app is provided so that a user such as a facility manager or owner can provide inputs to the system. In some embodiments, the software takes into account the available solar power not being used and a range of temperatures and times that the user specifies as being within a comfortable range. For example, in winter when a facility such as a home needs to be heated the user may specify a minimum desired indoor temperature of 65° F. between the hours of 7 am and 7 μm, and a maximum temperature of 74° F. in the same time frame. For the hours of 7 μm to 7 am, the user may specify a minimum desired indoor temperature of 60° F. and a maximum of 74° F., since they prefer it a bit cooler at night. At 7 am there is no excess available solar power, so the heat pump heats the home to 65° F. At 11 am, the home's electricity demand is 1 kilowatt and the solar panels are producing 6 kilowatts. That leaves 5 kilowatts of power that is available. The control system determines this and triggers the home's heat pump to run, using up to 5 kilowatts of power to heat the home. The indoor temperature gradually rises. If a cloud comes overhead and the solar panel output drops to 3 KW, the system sends only 2 kW to the heat pump for heating. This process continues until the maximum specified temperature of 74° F. is reached. Throughout the night, the home retains its heat stored in the thermal mass of the building materials and objects inside. Some heat is inevitably lost to the outside through the exterior surfaces and building envelope leaks, but the objects such as furniture inside the home will emit some of their heat into the air if the air temperature drops. This helps maintain a comfortable temperature throughout the night without the need to import grid power to run the heat pump when solar power is not available.

Figure 3A:
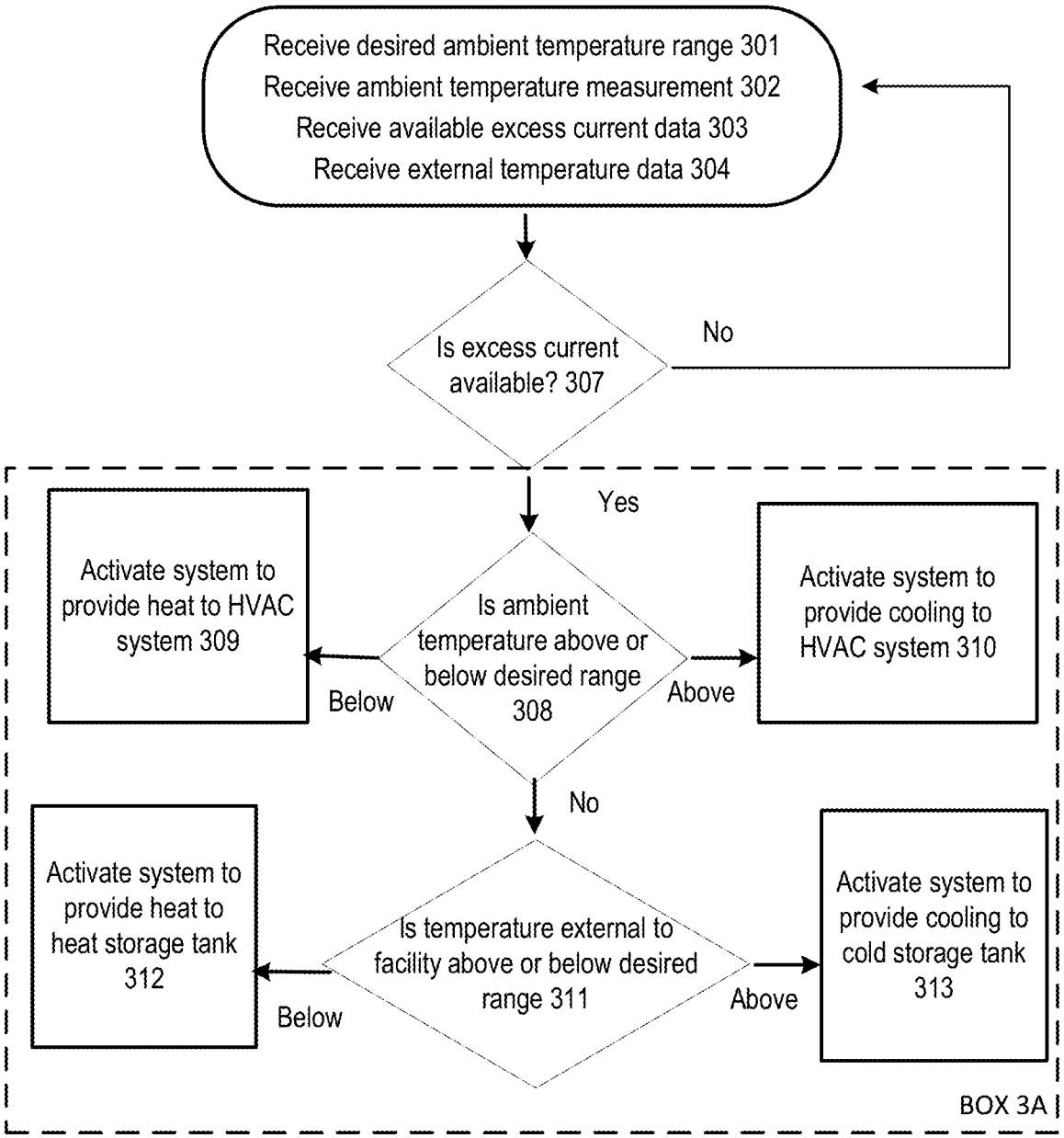
FIG. 3A shows a flow chart of operations of a thermal state assessment circuitry according to some embodiments of the present disclosure.

In some embodiments, such software is implemented via a thermal state assessment circuitry 300. In some embodiments, the thermal state assessment circuitry 300 is part of the thermal management system 200. In some embodiments, the thermal state assessment circuitry comprises one or more processors, computer memory hardware for storing data and software instructions, and input/output hardware that enables users to interact with the circuitry. FIG. 3A shows a flow chart showing logic applied in the circuitry 300 to engage the components of the thermal management system 200. In some embodiments, the thermal state assessment circuitry 300 is configured to receive 301 a desired ambient temperature range input. In some embodiments, this input is provided via a desktop or mobile app, and comprises one or more temperature ranges desired for the facility for one or more time blocks during a day, week, month or more. In some embodiments, the circuitry 300 is configured to receive 302 an ambient temperature measurement associated with the facility 100. Such data is supplied by one or more thermostats in some embodiments. The circuitry 300 is configured to receive 303 a signal from the current regulator 107 indicative of the amount of available excess current, and to compare the desired ambient temperature input and the ambient temperature measurement to determine whether to activate the heat pump.

As shown in FIG. 3A, the circuitry 300, in some embodiments, first determines if there is available excess current at 307. In some embodiments, the circuitry determines if the available excess current exceeds a threshold. In some embodiments, the threshold is selected by a user to provide sufficient power for the heat pump to operate effectively. In some embodiments the threshold is selected to accommodate changes in the facility's other power demands. For example, the threshold is set in some embodiments to enable the full effective operation of the thermal management system as well as additional electrical draws of 0.5 kilowatts. Such additional electrical draws can be considered a cushion to accommodate the turning on of a dishwasher, vacuum cleaner, etc.

The circuitry 300 is further configured to send instructions to the current regulator 107 to, if the available excess current exceeds the threshold: activate the heat pump 201 and activate the first glycol pump 212 to provide heat to the facility HVAC system 211 when the ambient temperature is below the desired ambient temperature range; and activate the heat pump 201 and activate the second glycol pump 215 to provide cooling to the facility HVAC system 211 when the ambient temperature is above the desired ambient temperature range.

Thus, the circuitry 300, if there is available excess current, will then determine if the ambient temperature is above or below the desired range at 308. If the ambient temperature is below the desired range, the system is activated to provide heat to the HVAC system at 309. If the ambient temperature is above the desired range, the system is activated to provide cooling to the HVAC system at 310.

In some embodiments, the thermal state assessment circuitry 300 is further configured to receive 304 temperature data about the environment external to the facility. After determining that the available excess circuitry exceeds the threshold, the circuitry is configured to send instructions to the current regulator to activate the heat pump 201 and activate the first glycol pump 212 to provide heat to the heat storage tank 202 when the ambient temperature is within the desired ambient temperature range and a temperature external to the facility 101 is above the desired ambient temperature range and activate the heat pump 201 and activate the second glycol pump 215 to provide cooling to the cold storage tank 203 when the ambient temperature is within the desired ambient temperature range and a temperature external to the facility 101 is below the desired ambient temperature range.

Thus, as shown in FIG. 3A, if the ambient temperature is within the desired range, but excess current is available, the system will activate to provide heat to the heat storage tank at 312 or activate to provide cooling to the cold storage tank at 313 depending on whether the external temperature is above or below the desired ambient temperature range at decision 311 (in other words, "summer" v. "winter" mode).

In some embodiments, the thermal state assessment circuitry 300 is further configured to receive 305 a desired hot water temperature range input and receive 306 a measurement of a hot water tank temperature. The circuitry 300 is configured to, if the available excess current exceeds the threshold, send instructions to activate the heat pump 201 and activate (315) the first glycol pump 212 to provide heat to the hot water tank 210 when the measurement of the hot water tank temperature is below the desired hot water temperature range (314). In some embodiments, the system is configured to also query whether the ambient temperature is within the desired range before providing heat to the hot water tank.

In some embodiments, the thermal state assessment circuitry 300 also includes logic for activating the system to utilize stored heat or cooling load so that running the compressor or drawing power from the power utility can be minimized. In some embodiments, the thermal state assessment circuitry is further configured to receive a signal from the heat storage tank indicating the amount of heat stored in the tank. Such a signal comprises data related to an internal temperature of the tank in some embodiments. In other embodiments, the signal comprises an indication of the phase composition of the material in the tank. In some embodiments, the circuitry 300 is further configured to receive a signal from the cold storage tank indicating the amount of cooling load stored in the tank. Such a signal comprises data related to an internal temperature of the tank in some embodiments. In other embodiments, the signal comprises an indication of the phase composition of the material in the tank.

The circuitry 300 is further configured to, if the available excess current does NOT exceed the threshold, activate a third glycol pump 216 associated with the heat storage tank 202 to provide glycol solution 213 heated by the heat storage tank to the facility HVAC system 211 when the ambient temperature is below the desired ambient temperature range and the heat storage tank contains sufficient heat; activate a fourth glycol pump 217 associated with the cold storage tank 203 to provide glycol solution 214 cooled by the cold storage tank to the facility HVAC system 211 when the ambient temperature is above the desired ambient temperature range and the cold storage tank contains sufficient cooling load; and activate the third glycol pump 216 to provide glycol solution 213 heated by the heat storage tank 202 to the hot water tank when the measurement of the hot water tank temperature is below the desired hot water temperature range and the heat storage tank contains sufficient heat. In some embodiments, sufficient heat means sufficient to increase the temperature of the indoor environment via the HVAC or increase the temperature of the hot water in the hot water tank. In some embodiments, sufficient cooling load means sufficient to decrease the temperature of the indoor environment via the HVAC.

Figure 3B:
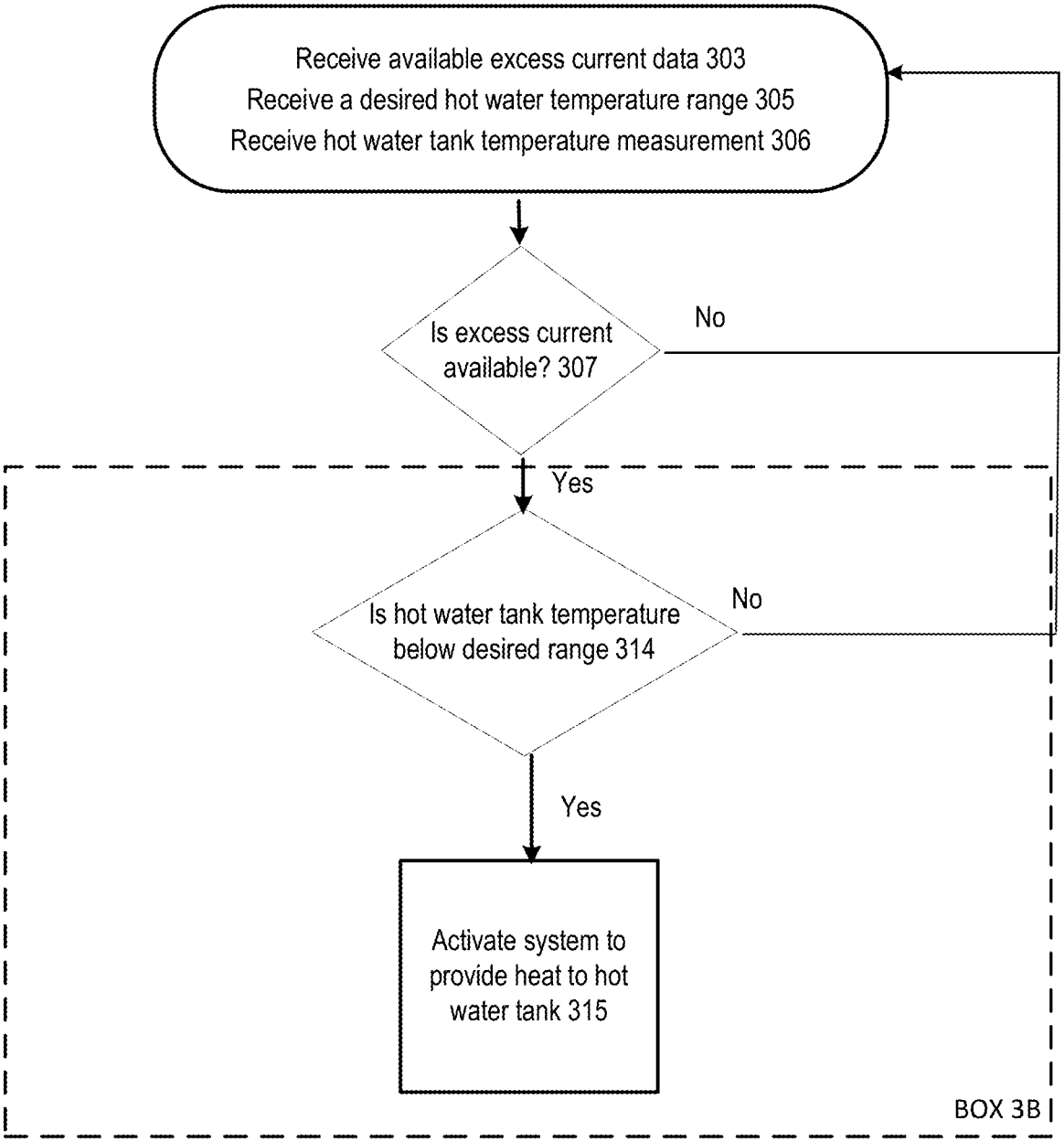
FIG. 3B shows a flow chart of additional operations of a thermal state assessment circuitry according to some embodiments of the present disclosure.
Figure 3C:
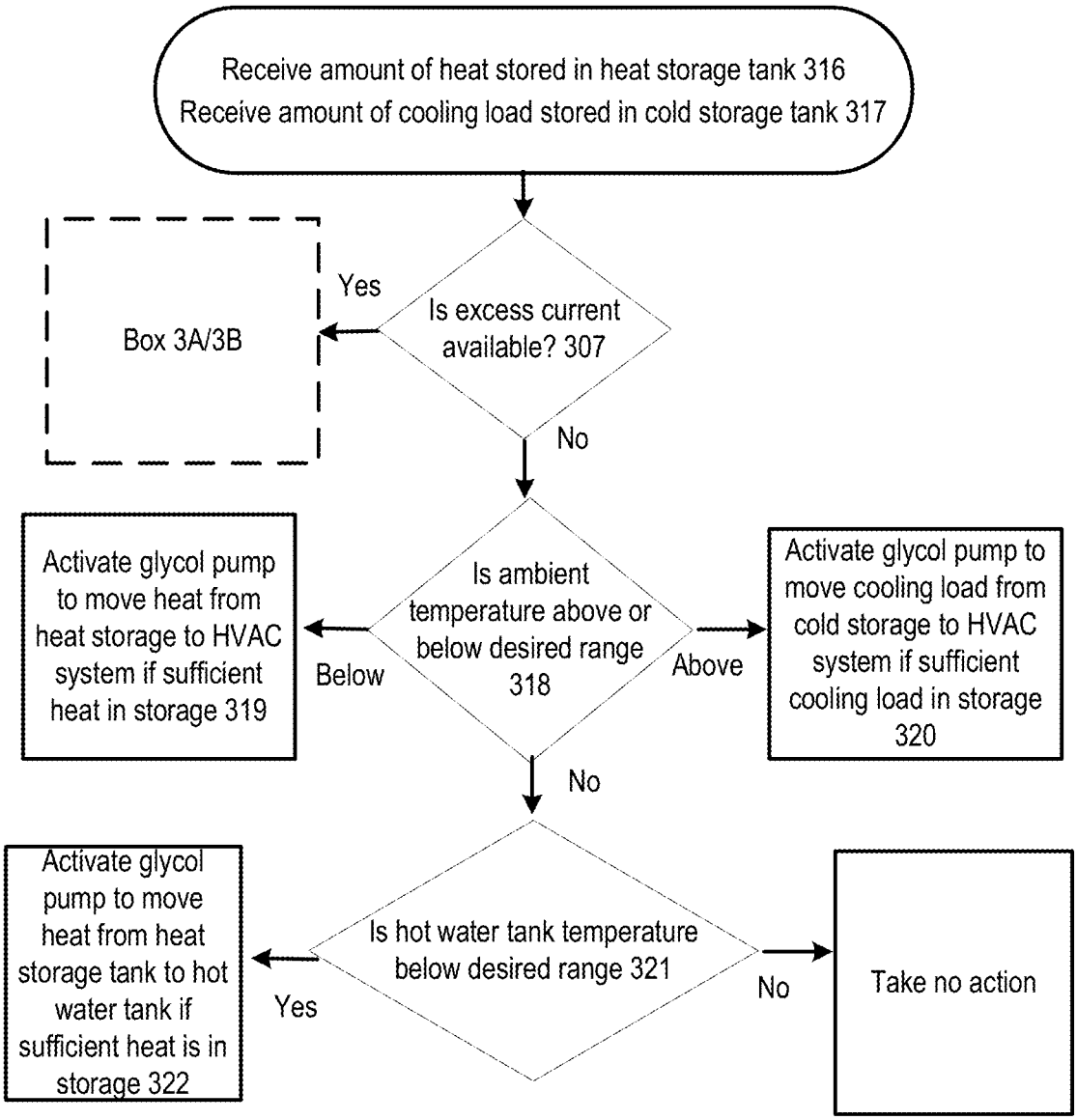
FIG. 3C shows a flow chart of additional operations of a thermal state assessment circuitry according to some embodiments of the present disclosure.

FIG. 3C shows a flowchart depicting an example of this logic. The circuitry takes as inputs 316 and 317 receiving the amounts of heat and cooling load stored in the heat and cold storage tanks. At decision 307, if there is available excess current, then the logic in FIGS. 3A and 3B is applied. If there is no available excess current, then the circuitry determines if the ambient temperature is above, below, or within the desired range at 318. If below, heat is moved from the heat storage tank to the HVAC system if sufficient heat is in the heat storage tank. If above, cooling load is moved from the cold storage tank to the HVAC system if sufficient cooling load is in the cold storage tank. If within, the circuitry determines at 321 whether the hot water tank temperature is below the desired range. If it is, heat is provided to the hot water tank if there is sufficient heat in storage.

In some embodiments, the thermal state assessment circuitry is highly customizable, so that individual facilities can have custom priorities for the use of excess available current. For example, some facilities may prioritize the hot water tank over providing heat to the HVAC or other indoor heating system. Other facilities may prioritize maintaining the heat storage tank over the hot water tank. The logic explained and illustrated herein can thus be rearranged to address different priorities.

Some embodiments of the present technology include thermal energy management systems that are installed to work with an existing electrical power system. In such embodiments, the system receives data from the electrical system indicative of excess current for use by the thermal energy management system.

Some embodiments of the present technology include non-transitory computer readable media that include software logic for performing the operations described herein, including by the thermal state assessment circuitry.

Among the advantages of some embodiments of energy management systems disclosed herein is that they allow the heat pump to run in heating mode more in the daytime hours when it is warmer outside and the heat pump's coefficient of power (COP) is higher. In some embodiments, the system can still be used in facilities without solar power to heat and cool the facility when electricity prices from the power company are lower, and when it is most efficient to run the heat pump to achieve a higher COP.

As shown in FIG. 1, in some embodiments, the system further comprises an electric vehicle charger 111 in electrical communication with the electrical power system 105, and wherein the current regulator 107 is configured to regulate the current flowing to an electric vehicle in electrical communication with the electric vehicle charger. In some embodiments, the current regulator is able to provide current to the EV charger when excess current is available and there is an indication that an electric vehicle battery can accept additional charge. In some embodiments, the facility user can prioritize EV charging when excess current is available over other uses of the excess current (e.g., into thermal storage).

In some embodiments, the current regulator is located inside of the EV charger. In some embodiments, the current regulator is inside the circuit breaker box in close proximity to the circuit breaker responsible for overcurrent protection of the charger. In some embodiments, the current regulator is built into the circuit breaker. If implemented in such a way that the current regulator is separate from the EV charger, any EV charger compatible with the vehicle can be used. If implemented as part of the EV charger itself, a communication mechanism within the EV charger is used to determine the state of charge (SOC) of the vehicle in order to stop charging when the desired SOC has been reached.

In some embodiments, the current regulator is located in its own module. In some embodiments, the current regulator is inside the circuit breaker box in close proximity to the circuit breaker responsible for overcurrent protection of heat pump circuits. In some embodiments, the current regulator is built into the circuit breaker.

As used in any embodiment herein, the terms "logic" and/or "module" may refer to an app, software, firmware and/or circuitry configured to perform any of the aforementioned operations. Software may be embodied as a software package, code, instructions, instruction sets and/or data recorded on non-transitory computer readable storage medium. Firmware may be embodied as code, instructions or instruction sets and/or data that are hard-coded (e.g., nonvolatile) in memory devices.

"Circuitry," as used in any embodiment herein, may include, for example, singly or in any combination, hard-wired circuitry, programmable circuitry such as computer processors comprising one or more individual instruction processing cores, state machine circuitry, and/or firmware that stores instructions executed by programmable circuitry. The logic and/or module may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc.

Memory may include one or more of the following types of memory: semiconductor firmware memory, programmable memory, non-volatile memory, read only memory, electrically programmable memory, random access memory, flash memory, magnetic disk memory, and/or optical disk memory. Either additionally or alternatively system memory may include other and/or later-developed types of computer-readable memory.

Embodiments of the operations described herein may be implemented in a computer-readable storage device having stored thereon instructions that when executed by one or more processors perform the methods. The processor may include, for example, a processing unit and/or programmable circuitry. The storage device may include a machine readable storage device including any type of tangible, non-transitory storage device, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of storage devices suitable for storing electronic instructions.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. A system for managing energy in a facility, comprising:

an electrical energy measurement circuitry, comprising:

one or more ammeters and one or more voltmeters configured to measure an amount of electrical power supplied to the facility and an amount of electrical power demand by the facility;

a controller circuitry configured to calculate an amount of available excess electrical power from the measured amounts; and a current regulator configured to regulate the available excess current within an electrical power system of the facility;

a thermal energy management system, comprising:

a heat pump in electrical communication with the current regulator and configured such that its operation is regulated by the current regulator;

a heat storage tank, thermally coupled to the heat pump; and a cold storage tank, thermally coupled to the heat pump;

wherein the heat pump further comprises:

a compressor;

a first heat exchanger that couples the heat pump to the heat storage tank; a reversing valve;

a second heat exchanger that couples the heat pump to the cold storage tank;

one or more metering devices; and a third heat exchanger that couples the heat pump to the environment external to the facility;

wherein refrigerant in the heat pump heats a glycol solution via the first heat exchanger to provide heat to one or more of the heat storage tank, a hot water tank, and a facility heating, cooling, and ventilation (HVAC) system via a first glycol pump; and wherein refrigerant in the heat pump cools a second glycol solution via the second heat exchanger to provide cooling to the cold storage tank and the facility HVAC system via a second glycol pump;

a thermal state assessment circuitry, configured to:

receive a desired ambient temperature range input;

receive an ambient temperature measurement;

receive a signal from the current regulator indicative of the amount of available excess current;

compare the desired ambient temperature input and the ambient temperature measurement to determine whether to activate the heat pump;

send instructions to the current regulator to, if the available excess current exceeds a threshold:

activate the heat pump and activate the first glycol pump to provide heat to the facility HVAC system when the ambient temperature is below the desired ambient temperature range; and activate the heat pump and activate the second glycol pump to provide cooling to the facility HVAC system when the ambient temperature is above the desired ambient temperature range.

2. The system of claim 1, further comprising a solar photovoltaic system in electrical communication with the electrical power system, the solar photovoltaic system configured to convert solar energy into electrical energy and send the electrical energy to the electrical power system.

3. The system of claim 2, wherein the electrical energy measurement circuitry further comprises:

a first ammeter in electrical communication with the solar photovoltaic system, the first ammeter configured to measure the current sent from the solar photovoltaic system;

a first voltmeter in electrical communication with the solar photovoltaic system, the first voltmeter configured to measure the voltage sent from the solar photovoltaic system; and the system further comprises:

at least one second ammeter in electrical communication with a circuit of the electrical power system, the at least one second ammeter configured to measure the total current drawn from the circuit;

at least one second voltmeter in electrical communication with the circuit of the electrical power system, the at least one second voltmeter configured to measure the total voltage drawn from the circuit; and wherein the controller circuitry is configured to receive the measurements from the first and second ammeters and voltmeters to calculate the amount of available excess electrical current.

4. The system of claim 1, wherein the thermal state assessment circuitry is further configured to:

receive external temperature data;

send instructions to the current regulator to, if the available excess current exceeds the threshold:

activate the heat pump and activate the first glycol pump to provide heat to the heat storage tank when the ambient temperature is within the desired ambient temperature range and a temperature external to the facility is above the desired ambient temperature range; and activate the heat pump and activate the second glycol pump to provide cooling to the cold storage tank when the ambient temperature is within the desired ambient temperature range and a temperature external to the facility is below the desired ambient temperature range.

5. The system of claim 4, wherein the thermal state assessment circuitry is further configured to:

receive a desired hot water temperature range input;

receive a measurement of a hot water tank temperature;

send instructions to the current regulator to, if the available excess current exceeds the threshold:

activate the heat pump and activate the first glycol pump to provide heat to the hot water tank when the measurement of the hot water tank temperature is below the desired hot water temperature range.

6. The system of claim 5, wherein the thermal state assessment circuitry is further configured to:

receive a signal from the heat storage tank indicating the amount of heat stored in the tank;

receive a signal from the cold storage tank indicating the amount of cooling load stored in the tank; and send instructions to the current regulator to, if the available excess current does not exceed the threshold:

activate a third glycol pump associated with the heat storage tank to provide glycol solution heated by the heat storage tank to the facility HVAC system when the ambient temperature is below the desired ambient temperature range and the heat storage tank contains sufficient heat;

activate a fourth glycol pump associated with the cold storage tank to provide glycol solution cooled by the cold storage tank to the facility HVAC system when the ambient temperature is above the desired ambient temperature range and the cold storage tank contains sufficient cooling load; and activate the third glycol pump to provide glycol solution heated by the heat storage tank to the hot water tank when the measurement of the hot water tank temperature is below the desired hot water temperature range and the heat storage tank contains sufficient heat.

7. The system of claim 1, wherein the heat storage tank comprises one or more of: water and a phase change material.

8. The system of claim 1, wherein the cold storage tank comprises water.

9. The system of claim 1, further comprising a second heat pump arranged in a cascading relationship to one of the first heat exchanger and the second heat exchanger.

10. The system of claim 1, further comprising a second heat pump arranged in a cascading relationship to the first heat exchanger and a third heat pump arranged in a cascading relationship to the second heat exchanger.

11. The system of claim 1, further comprising an electric vehicle charger in electrical communication with the electrical power system, and wherein the current regulator is configured to regulate the current flowing to an electric vehicle in electrical communication with the electric vehicle charger.

* * * * *